US010904678B2

(12) United States Patent
El Guindi

(10) Patent No.: US 10,904,678 B2
(45) Date of Patent: Jan. 26, 2021

(54) REDUCING NOISE FOR A HEARING DEVICE

(71) Applicant: Sonova AG, Staefa (CH)

(72) Inventor: Nadim El Guindi, Zürich (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/191,458

(22) Filed: Nov. 15, 2018

(65) Prior Publication Data

US 2020/0162825 A1 May 21, 2020

(51) Int. Cl.
*H04R 25/00* (2006.01)
*G10L 25/84* (2013.01)

(52) U.S. Cl.
CPC ..... *H04R 25/505* (2013.01); *G10L 25/84* (2013.01); *H04R 25/554* (2013.01); *H04R 2225/51* (2013.01)

(58) Field of Classification Search
CPC ..... H04R 25/00; H04R 25/55; H04R 25/558; H04R 2225/49; H04R 2460/01
USPC ..... 381/312, 315, 317, 320
See application file for complete search history.

(56) References Cited

U.S. PATENT DOCUMENTS 9,763,017 B2 9/2017 Roeck
2015/0163602 A1* 6/2015 Pedersen ..... H04R 25/554 381/315

* cited by examiner

*Primary Examiner* — Suhan Ni

(57) ABSTRACT

The disclosed technology relates to a hearing device configured to reduce audio artifacts related to electromagnetic interference between a transceiver and a T-coil. The hearing device can include a T-coil configured to receive audio signal; a processor configured to communicate with a transceiver, to process the EM inductive audio signal, and to provide a processed audio signal to a transducer. The processor can communicate with a memory to access instructions that include operations to: determine that the hearing device is receiving the EM inductive audio signal from the T-coil; determine that a noise associated with EM interference and the T-coil is anticipated based on the notification from the transceiver; and determine whether to apply a filter to the processed audio signal based on a sound level of the processed audio signal being below a masking threshold during a duration of the noise.

21 Claims, 6 Drawing Sheets

REDUCING NOISE FOR A HEARING DEVICE

TECHNICAL FIELD

The disclosed technology generally relates to a hearing device with a telecoil. More specifically, the disclosed technology relates to a hearing device configured to reduce audio artifacts or noise related to electromagnetic interference (EMI) with a telecoil.

BACKGROUND

Some hearing devices have a telecoil (T-coil). The T-coil is generally a small wire located inside of a hearing device that functions as an antenna to receive electromagnetic (EM) signals. T-coils are comprised of a metal core (or rod) around which a wire is coiled. T-coils are also called "induction coils" because when the coil is placed in an alternating EM field then an alternating electrical current is induced into the wire.

Hearing devices can include hearing aids and hearing aid users have access to several sources of EM energy. The most common source being the EM field generated by hearing-aid compatible telephones. Traditional corded land-line and some cordless phones and analog wireless phones generate EM fields that can be detected by the T-coil in a hearing aid. Other sources of EM energy are induction loop (IL) assistive listening devices. These systems, which consist of a microphone and amplifier to which a "loop" is connected which can generate an EM field. Room loop systems are available for use in auditoriums and other large settings (e.g., movie theaters). Also, portable IL systems that use a lasso-type loop of different sizes can be placed around a conference table or chair.

In addition to a T-coil, a hearing device can have a transceiver with an antenna that receives or transmits EM signals for wireless communication in an unlicensed or licensed frequency band. For example, the transceiver can use an antenna to transmit wireless communication signals in the 2.4 GHz frequency band associated with Bluetooth™ or binaural communication protocols. When the transceiver transmits or receives EM signals, it can create unwanted EMI that is picked up by the T-coil in a hearing device. Specifically, the EMI can create a buzzing or clicking audio artifact in an audio signal received by a T-coil.

Although the transceiver typically does not use audio signal transmission/reception when the T-coil is active, the transceiver may be used for other purposes such as for remote control purposes or communicating with a mobile phone during times when the T-coil is active. Accordingly, there exists a need to address the above-mentioned problems and provide additional benefits.

SUMMARY

This summary is provided to introduce a selection of concepts in a simplified form that are further described below in the Detailed Description. This summary is not intended to identify key features of the claimed subject matter.

The disclosed technology includes a method (e.g., a computed-implemented method) and a hearing device configured to implement the method. The method can include receiving a notification that indicates a first antenna (e.g., an antenna configured for wireless communication using Bluetooth™) of a hearing device is expected to receive or generate an electromagnetic field that could interference with a second antenna (e.g., T-coil antenna) of the hearing device while the second antenna is receiving an audio signal. The EM field could interfere with the received audio signal and create a noise (e.g., a clicking noise). The method can further comprise: determining whether to apply a filter to the received audio signal based on a sound level of the received audio signal compared to a threshold (e.g., an amplitude of the received signal) during a duration of the noise. The duration of the noise can be based on packet length or a time period associated with the EM field (e.g., the duration of the noise is estimated based on how long an EM field lasts or the length of a packet transmitted by the antenna, which is associated with a time period for how long an EM field interferes with another antenna). For example, the method can include applying the filter if the audio signal is not louder than the noise and not applying the filter when the audio signal is louder than the noise. This determination can be based on an amplitude value of the frequency components of the received audio signal, where the received audio signal includes noise (unwanted) and audio (desired).

The method can also comprise providing a processed audio signal based on the received audio signal (e.g., after filtering or not filtering, or based on combining the received audio signal with other audio signals to produce audio or output audio signals). The method can be implemented by the processor of the hearing device or the method can be stored in the memory of the hearing device.

Figure 1:
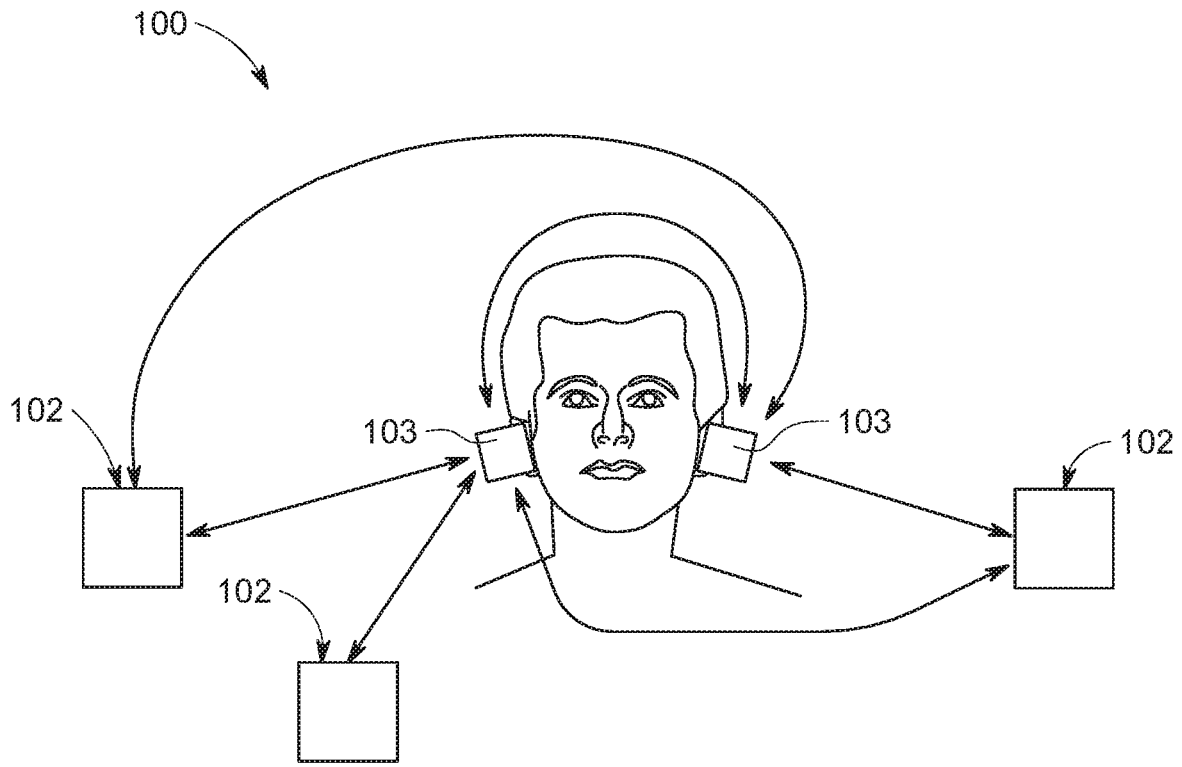
FIG. 1 illustrates a communication environment in accordance with some implementations of the disclosed technology.

The drawings are not to scale. Some components or operations may be separated into different blocks or combined into a single block for the purposes of discussion of some of the disclosed technology. Moreover, while the technology is amenable to various modifications and alternative forms, specific implementations have been shown by way of example in the drawings and are described in detail below. The intention, however, is not to limit the technology to the selected implementations described. On the contrary, the technology is intended to cover all modifications, equivalents, and alternatives falling within the scope of the technology as defined by the appended claims.

DETAILED DESCRIPTION

The disclosed technology relates to a hearing device configured to reduce unwanted audio artifacts related to EMI with a hearing device T-coil. To reduce EMI that causes unwanted audio artifacts, the hearing device can execute a method to selectively apply a filter to processed audio signals. Here, a T-coil can also be referred to as an "antenna" because it is configured to receive an EM field.

The method can comprise: receiving a notification that indicates a first antenna of a hearing device is expected to receive or generate an EM field that could interfere with a second antenna of the hearing device while the second antenna is receiving an audio signal. Here, the hearing device transceiver can send the notification to a processor of the hearing device before the transceiver is expected to generate the EM field. Expected to generate means the hearing device will shortly activate its antenna, e.g., to transmit or receive an a packet of information. Shortly activate generally means within a few milliseconds. The method can further comprise: determining whether to apply a filter to the received audio signal based on a sound level of the received audio signal compared to a threshold during a duration of the audible noise. The method can also comprise providing a processed audio signal based on the received audio signal and the determination of whether to apply the filter.

As a non-limiting example of the disclosed technology, a hearing device processes an audio signal from a T-coil to reduce a click noise, which relates to EMI between the T-coil and the antenna of the hearing device. The hearing device transceiver sends a notification to processor of the hearing device and the processor forwards the audio signal to a digital signal processor (DSP). Based on the received notification, the DSP activates a filter in the 2-4 KHz range and attenuates the audio signal by 10 dB for the duration of the click noise. The hearing device can determine that the T-coil is receiving a loud signal (e.g., above 55-60 dB) and that it is not necessary to apply the filter because the loud signal "perceptually masks" or "covers up" the click noise as described in more details in FIGS. 2, 3, and 4B.

The disclosed technology solves at least the technical problem of reducing noise in a hearing device and provides additional technical benefits. For example, the disclosed technology reduces sound artifacts created from EMI with a T-coil. As another example, the disclosed technology enables simultaneous operation of a transceiver and T-coil with reduced (e.g., minimized) impact on sound quality while the T-coil is in operation. Hearing device users will notice an improved performance because the hearing device creates less noise when using its T-coil.

FIG. 1 illustrates a communication environment 100. The communication environment 100 includes wireless communication devices 102 and hearing devices 103. As shown by double-headed bold arrows in FIG. 1, the wireless devices 102 and the hearing devices 103 can communicate wirelessly, e.g., each wireless communication device 102 can communicate with each hearing device 103. Also, each hearing device 103 can communicate with the other hearing device 103.

Wireless communication can include T-coil communications or using a protocol. A protocol can include Bluetooth Basic Rate/Enhanced Data Rate™, Bluetooth Low Energy™, a proprietary communication (e.g., binaural communication protocol between hearing aids or bimodal communication protocol between a hearing aid and hearing device), ZigBee™, Wi-Fi™, or an Industry of Electrical and Electronic Engineers (IEEE) wireless communication standard.

The wireless communication devices 102 are computing devices that are configured to wirelessly communicate. Wireless communication includes wirelessly transmitting information, wirelessly receiving information, or both. The wireless communication devices 102 shown in FIG. 1 include computers (e.g., desktop or laptop), televisions (TVs) or components in communication with television (e.g., TV streamer), telephone, a car audio system or circuitry within the car, a mobile device (e.g., smartphone), tablet, remote control, an accessory electronic device, a wireless speaker, or watch. It should be noted that the hearing device 103 is also a wireless communication device 102, but the hearing device 103 can provide audio to a user in addition to wirelessly communicating with other devices.

The hearing devices 103 are devices that provide audio to a user wearing the hearing devices. Some example hearing devices include hearing aids, headphones, earphones, assistive listening devices, or any combination thereof; and hearing devices include both prescription devices and non-prescription devices configured to be worn on or near a human head. As an example of a hearing device, a hearing aid is a device that provides amplification, attenuation, or frequency modification of audio signals to compensate for hearing loss or attenuation functionalities; some example hearing aids include a Behind-the-Ear (BTE), Receiver-in-the-Canal (RIC), In-the-Ear (ITE), Completely-in-the-Canal (CIC), Invisible-in-the-Canal (IIC) hearing aids or a cochlear implant (where a cochlear implant includes a device part and an implant part).

A hearing device user can wear the hearing devices 103 and the hearing devices 103 can be streaming audio. Streaming audio between the hearing devices can include during wind noise canceling or during hearing device programs (e.g., hearing aids that exchange audio information). For example, the hearing device 103 can stream audio from a phone, where the phone uses another T-coil to communicate the T-Coil in the hearing device. T-coil communication can be used in other settings such as listening to a broadcast, listening to a movie, or streaming music from a device that provides audio via another T-coil.

The hearing devices 103 are configured to binaurally communicate or bimodally communicate. The binaural communication can include a hearing device 103 transmitting information to or receiving information from another hearing device 103. Information can include volume control, signal processing information (e.g., noise reduction, wind canceling, directionality such as beam forming information), or compression information to modify sound fidelity or resolution. Binaural communication can be bidirectional (e.g., between hearing devices) or unidirectional (e.g., one hearing device receiving or streaming information from another hearing device). Bimodal communication is like binaural communication, but bimodal communication includes a cochlear device communicating with a hearing aid.

Figure 2:
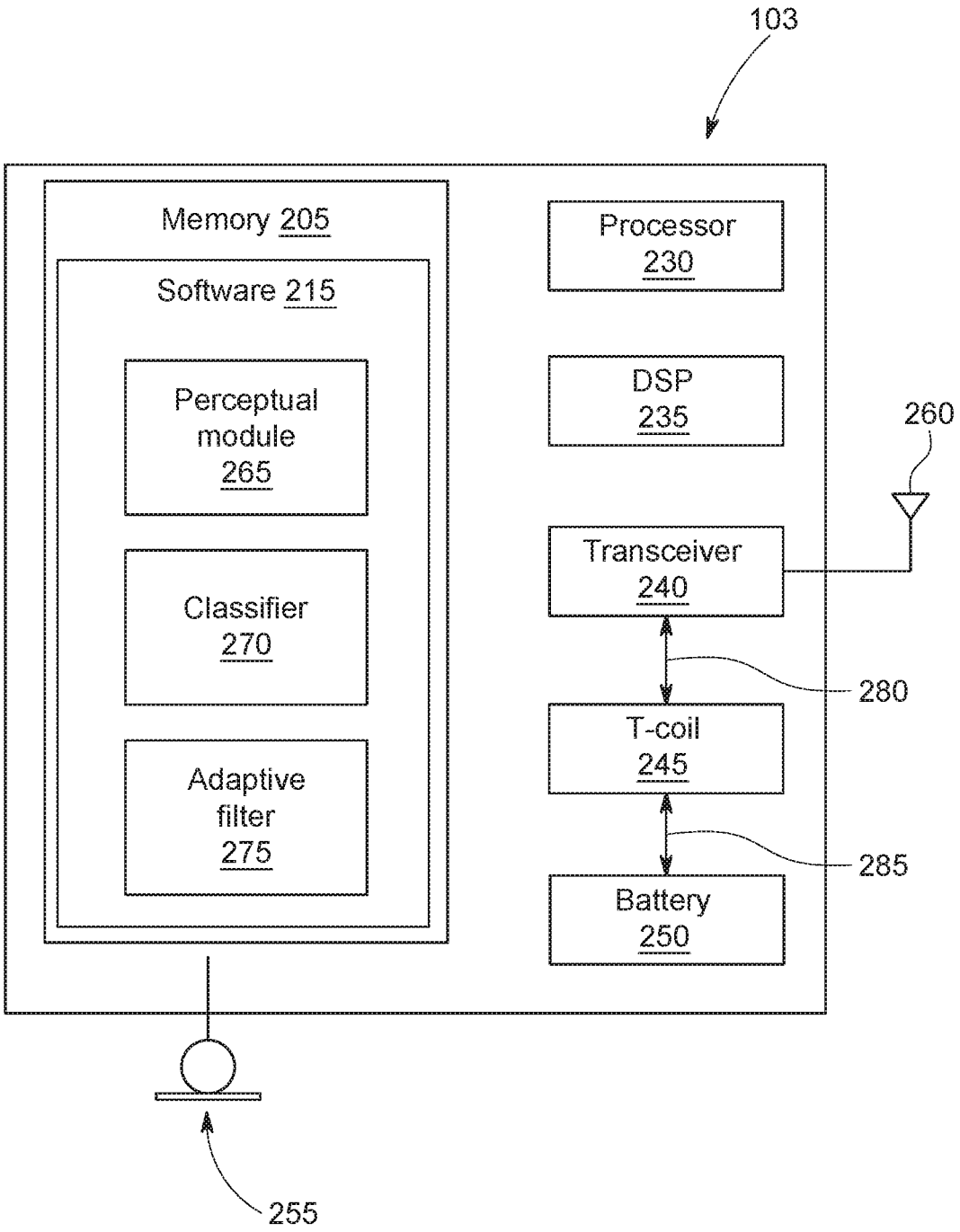
FIG. 2 illustrates a hearing device from FIG. 1 in more detail in accordance with some implementations of the disclosed technology.

FIG. 2 is a block diagram illustrating the hearing device 103 from FIG. 1 in more detail. FIG. 2 illustrates the hearing device 103 with a memory 205, software 215 stored in the memory 205, the software 215 includes a perceptual module 265, a classifier 270, and an adaptive filter 275. The hearing device 103 also includes a processor 230, a DSP 235, a transceiver 240, a T-coil 245, battery 250, a microphone 255, and an antenna 260. The antenna 260 can be referred to as a "first antenna" and the T-coil 245 can be referred to as "second antenna" because both antennas are configured to receive or transmit information as part of an EM field.

As shown by the double-headed bold arrow 280, EMI can occur between the T-coil 245 and the transceiver 240. More specifically, the transceiver 240 and/or the antenna 260 can generate EMI that affects the T-coil 245. For example, when the antenna 260 transmits or receives a packet based on a request from the transceiver 240, EMI can be generated. The properties of the battery 250 as shown by the doubled headed arrow 285 can influence the EMI (e.g., the strength, the location). More specifically, the battery 250 can be composed of material (e.g., metal) that influences or even creates EMI that affects the T-coil 245. Some materials can increases the strength of the EMI and other materials can weaken it. Also, a non-rechargeable zinc air battery has different electromagnetic properties compared to a rechargeable lithium ion battery. Accordingly, when determining the strength, duration, or type of noise created from EMI, the disclosed technology can use properties of the battery 250 and the associated power management system of the hearing device to estimate the click noise.

Also, the design of the electronic circuitry for the hearing device 103, including placement and design of components, the power management system, and shielding have an impact on the electromagnetic properties of the hearing device 103. As a result, the design of the electronic circuitry properties can also impact how EMI affects the hearing device 103. The parameters associated with the electronic circuitry of the hearing device can also be used to compute a threshold and parameters of click noise created from the EMI. In some implementations, the design of the electronic circuitry can have more significant impact on the EMI than the properties of the battery 250.

To reduce noise created by this EMI, the hearing device 103 can use the modules in the software 215. The software 215 is comprised of one or more modules and data utilized by the modules. The software 215 includes a perceptual module 265, the classifier 270, and an adaptive filter 275 (also referred to as a "filter" generically). The modules perform certain methods or functions for the hearing device 103 and can include components, subcomponents, or other logical entities that assist with or enable the performance of these methods or functions. Although a single memory 205 is shown in FIG. 2, the hearing device 103 can have multiple memories 205 that are partitioned or separated, where each memory can store different information. Each of the modules is described in more detail below.

The perceptual module 265 determines whether to apply the adaptive filter 275. The perceptual module 265 can determine whether to apply the adaptive filter 275 based on a threshold. The threshold is a value set based on desired sound level of desired audio signals (e.g., signals received from the T-coil) and undesired signals (e.g., a click noise). The threshold can be based on an amplitude of a frequency component of the received audio signal or frequency components of the received audio signal. The threshold is set such that the typical undesired signal is below the threshold and the typical desired signal is above the threshold. For example, a perceptual module 265 can have a threshold of 40 dB. If the T-coil receives a signal above the threshold (e.g., 55-60 dB), the hearing device may not apply the adaptive filter 275 because the desired T-coil signal is louder than a click noise, which means the user cannot hear the click noise.

Figure 3:
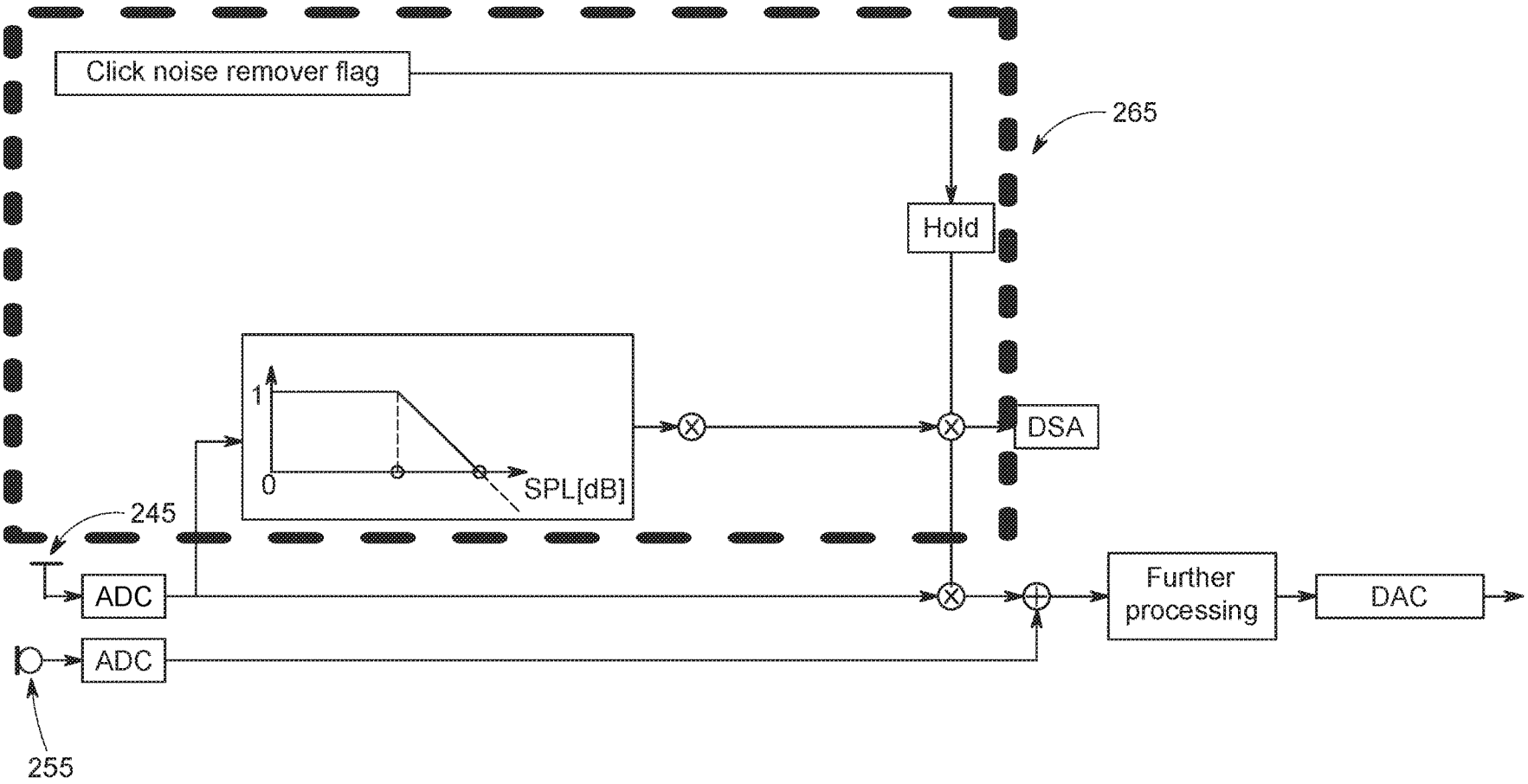
FIG. 3 illustrates a schematic diagram an operation to reduce click noise in a hearing device in accordance with some implementations of the disclosed technology.

Instead of a single threshold value, the threshold can be a "soft" or "two-sided" threshold with an first (e.g., upper) and a second (e.g., lower) value, e.g. 40 dB and 35 dB, respectively. If the T-coil receives a signal above the upper threshold (e.g., 40 dB), the hearing device may not apply the adaptive filter 275. If the T-coil receives a signal between the thresholds (e.g., between 40 dB and 35 dB), the hearing device may partially apply the adaptive filter 275. FIG. 4D illustrates more details regarding a first and second threshold. The perceptual module 265 can check the threshold in every frequency band independently. More details regarding the perceptual module are generally shown in FIG. 3.

The classifier 270 can classify received audio signals. The classifier 270 analyzes incoming audio signals to determine whether the received audio signals are speech, ambient noise, noise, click noise, or other common audio signals. The classifier 270 can also communicate this classification to the DSP 235, and the DSP 235 can determine how much gain should be applied to a processed signal according to an amplification scheme. Also, although the classifier 270 is shown outside of the DSP 235 in FIG. 2, the classifier 270 can be inside of the DSP 235 or part of the DSP 235. The classifier 270 can communicate classification information to the "further processing" as shown in FIG. 3. The classifier 270 can also communicate classification information to the adaptive filter 275 (or a unit that controls the adaptive filter).

The adaptive filter 275 is configured to filter audio signals for the hearing device 103. In general, the adaptive filter 275 can be time-variant because it changes or adapts overtime depending on the properties of the input signal (e.g., the signal to be filtered). For example, depending on the notification received from the transceiver 240 and T-coil input signal, the adaptive filter 275 can switch on and/or off and/or be applied partially or completely, in each frequency band. The adaptive filter 275 can include a custom filter, an active filter, a bandpass filter, a high-pass filter, or notch or band reject filter.

The adaptive filter 275 can filter processed audio from the T-coil 245 and other audio that is combined with the processed audio. The adaptive filter 275 can adapt based on communicating with the perceptual module 265. The adaptive filter 275 is also configured to filter audio signals on a frequency basis, e.g., each frequency band independently. The adaptive filter 275 can filter frequencies associated with a noise and not filter frequencies associated a desired audio signal such as a T-coil signal. Although the adaptive filter 275 is shown as separate from the DSP 235, the adaptive filter 275 can be part of the DSP 235. For example, the DSP 235 can activate the adaptive filter 275 in the 2-4 KHz region to attenuate an audio signal in this range by 10 dB for the duration of a noise.

The processor 230 can include special-purpose hardware such as application specific integrated circuits (ASICs), programmable logic devices (PLDs), field-programmable gate arrays (FPGAs), programmable circuitry (e.g., one or more microprocessors microcontrollers), appropriately programmed with software and/or computer code, or a combination of special purpose hardware and programmable circuitry. As shown in FIG. 2, the hearing device 103 can have a separate DSP 235 to process audio signals. Yet, in some implementations, the processor 230 can be combined with the DSP 235 in a single unit, wherein the processor 230 can process audio signals. Also, in some implementations, the hearing device 103 can have multiple processors, where the multiple processors can be physically coupled to the hearing device 103 and configured to communicate with each other.

The battery 250 can be a rechargeable battery (e.g., lithium ion battery) or a non-rechargeable battery (e.g., Zinc-Air) and the battery 250 can provide electrical power to the hearing device 103 or its components. Because some rechargeable batteries are composed of different material compared to non-rechargeable batteries, some rechargeable batteries have different magnetic or electrical properties compared to non-rechargeable batteries. Also, if the rechargeable batteries have different magnetic or electrical properties these rechargeable batteries can respond differently to EMI or EM fields in general. For example, rechargeable batteries may have a more significant reaction (e.g., more EM flux) compared to non-rechargeable batteries in the presence of EMI. Also, the size and location of a battery in the hearing device can determine how EMI will interact with it. For example, a large battery may have a more significant response to EMI than a small battery. Accordingly, when the hearing device is designed, the EMI properties of the battery 250 and/or the properties of the electronic circuitry of the hearing device can be saved in memory and the EMI properties and used to set the threshold or anticipated noise properties for EMI. More specifically, when performing click noise removal operations, the hearing device can adjust its adaptive filter 275 or threshold based on the stored properties of the battery.

The microphone 255 is configured to capture sound and provide an audio signal of the captured sound to the processor 230. The processor 230 can modify the sound (e.g., in a DSP) and provide the modified sound to a user of the hearing device 103. Although a single microphone 255 is shown in FIG. 2, the hearing device 103 can have more than one microphone. For example, the hearing device 103 can have an inner microphone, which is positioned near or in an ear canal, and an outer microphone, which is positioned on the outside of an ear. As another example, the hearing device 103 can have two microphones, and the hearing device 103 can use both microphone to perform beam forming operations. In such an example, the processor 230 can include a DSP configured to perform beam forming operations.

The transceiver 240 communicates with the antenna 260 to transmit or receive information. The antenna 260 is configured to operation in unlicensed bands such as Industrial, Scientific, and Medical Band (ISM)) using a frequency of 2.4 GHz. The antenna 260 can also be configured to operation in other frequency bands such as 5 GHz, 5 MHz, 10 MHz, or other unlicensed or licensed bands.

Although not shown in FIG. 2, the hearing device can also include a transducer to output audio signals (e.g., a loudspeaker or a transducer for a cochlear device configured to convert audio signals into nerve stimulation or electrical signals).

FIG. 3 illustrates a schematic diagram of an operation to reduce click noise in a hearing device with the perceptual module 265. Here the perceptual module 265 is shown schematically with a dashed line. Starting from the left side of FIG. 3, FIG. 3 includes two analog to digital converters (ADCs), the microphone 255, the T-coil 245, and a box that states "click noise remover flag". This click noise remover flag is a notification that is received from the transceiver 240. The notification indicates that the transceiver 240 or the antenna 260 coupled to the transceiver 240 will shortly (e.g., within a millisecond) generate an EM field to transmit or receive a packet of information. When this EM field is generated, it will likely cause EMI with the T-coil 245 and a noise will be generated if the T-coil 245 is receiving (e.g., streaming) an audio signal from another device.

The notification can generate a "hold" as shown in FIG. 3. The hold indicates that an output of a processed audio signal is held for a small amount of time (e.g., 1 millisecond) while the ADC converts analog signal to an digital signal. This small amount of hold time allows for smooth activation of the adaptive filter 275 and gives the perceptual module 265 enough time to include the aspect of temporal forward masking during this hold time. As shown in a graph in the left center of FIG. 3, the perceptual module 265 can apply filter with 100% weight (e.g., as shown by the "1") or apply the filter at less than 100% weight (e.g., 0) to an incoming audio signal. The adaptive filter 275 can also apply with a weight of less than 100% (as shown by the negative slope in the graph of the FIG. 3 or shown in FIG. 4D). The adaptive filter 275 is applied based on the sound pressure level (SPL) in dB for an incoming audio signal from the T-coil 245. More specifically, as discussed in FIG. 2, if the sound level is above a threshold, the adaptive filter is applied, and if the sound level is below a threshold, the filter is not applied. The adaptive filter 275 can be applied on a frequency band basis and the weights of the adaptive filter can be based on the shape of audio signal as further descripted in FIGS. 4A, 4B, and 4C.

FIG. 3 also includes a dual slope averager (DSA), further processing, and a digital to analog converter (DAC). The DSA is a filter with asymmetric behavior (e.g. fast attack, slow release) to create a smooth envelope for a processed audio signal. Here, the envelope can define a temporal activation/deactivation pattern of the adaptive filter 275. The further processing can include operations to improve or modify (e.g., further gain, mixing) the processed audio signal. The DAC can convert a digital signal to an analog signal for output (e.g., to a loudspeaker or cochlear implant device).

Figure 4A:
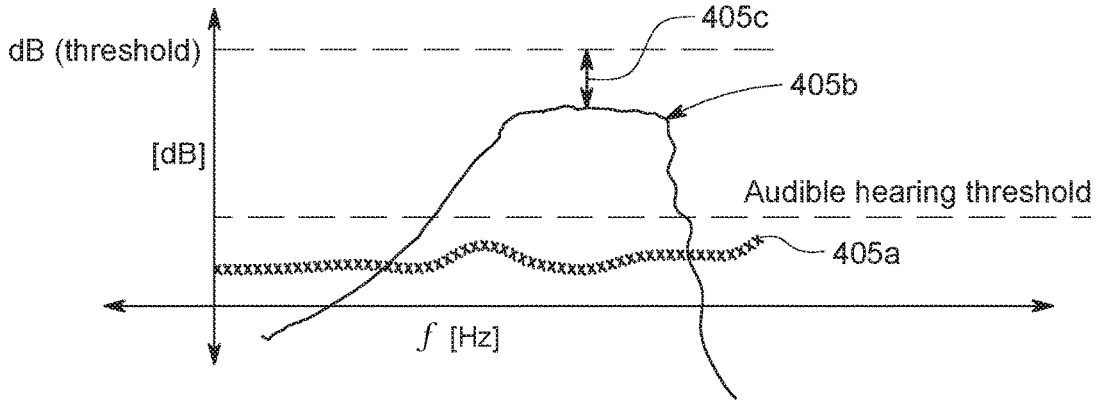
FIGS. 4A, 4B, and 4C schematic illustrate example graphs of an audio signal and noise signal in accordance with some implementations of the disclosed technology.
Figure 4B:
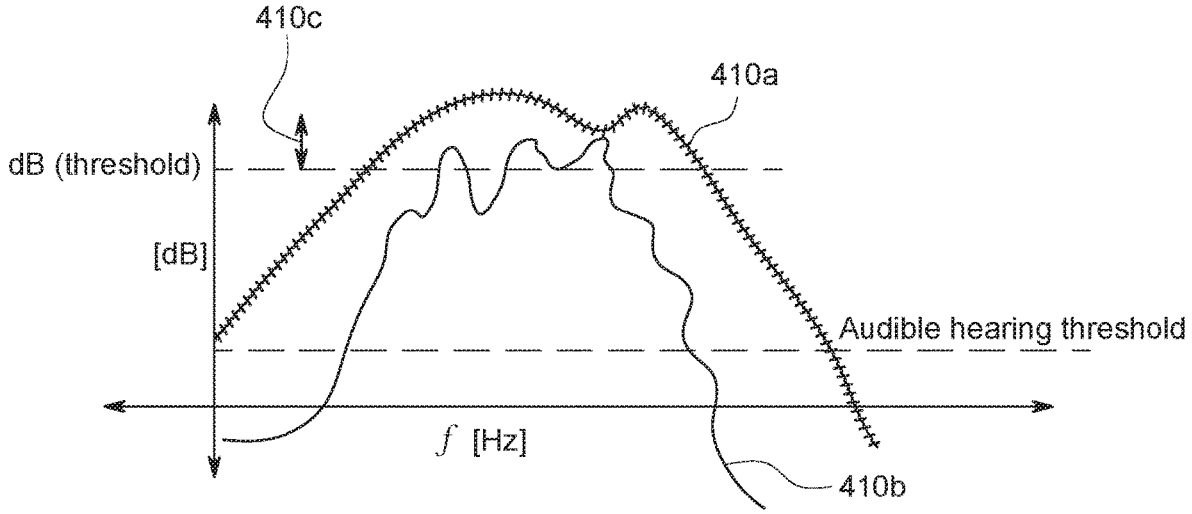
Figure 4C:
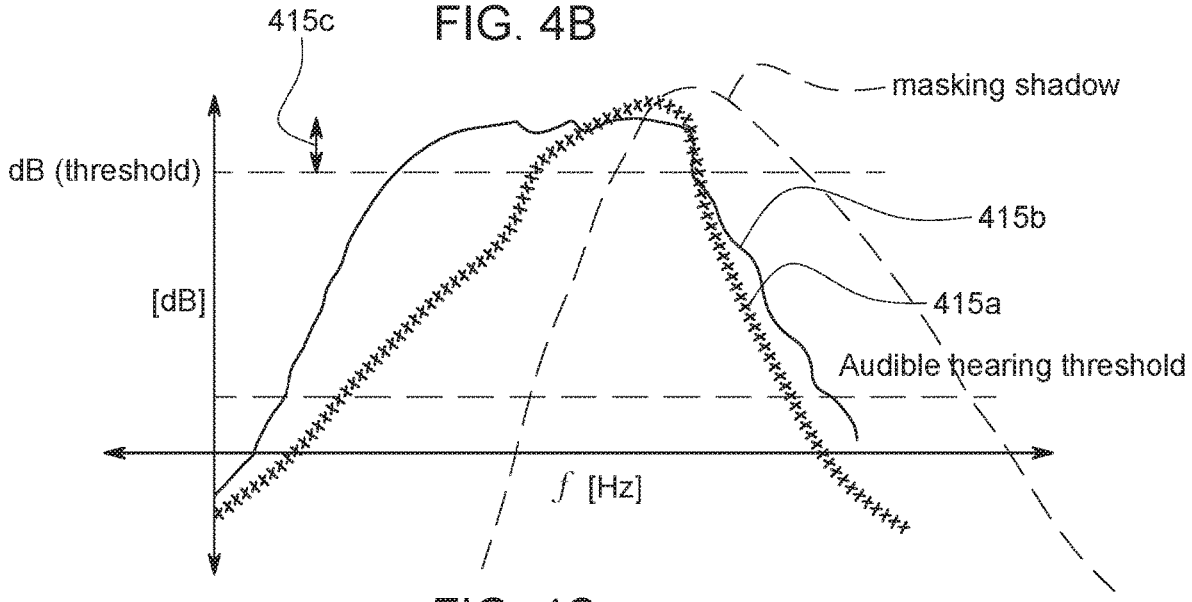
Figure 4D:
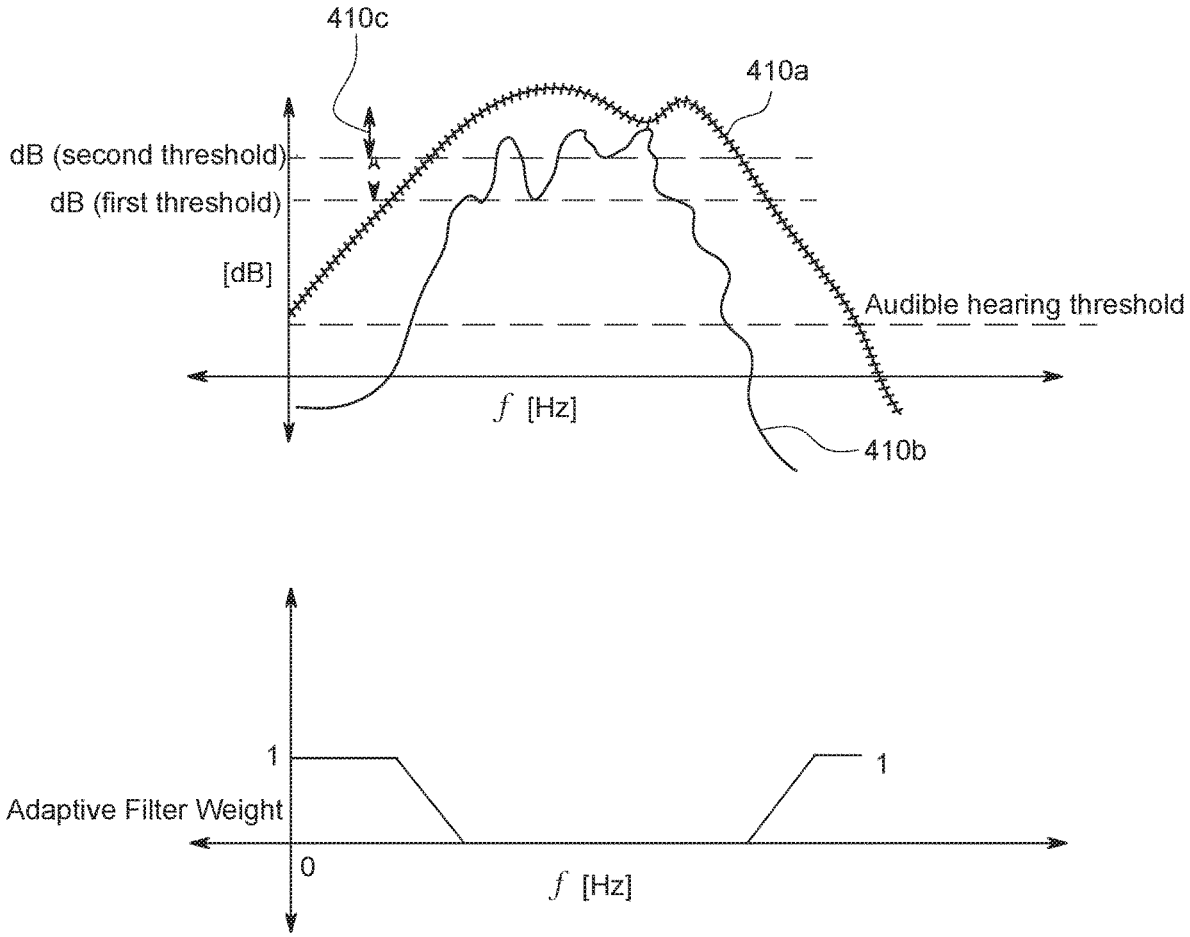
FIG. 4D illustrates a schematic example graph of an audio signal and a noise signal juxtaposed a schematic graph of an adaptive filter with filter weights in accordance with some implementations of the disclosed technology.

FIGS. 4A, 4B, and 4C illustrate schematic example graphs of a processed audio signal and noise signal with respect to a threshold and an audible hearing threshold. These schematic example graphs are shown for illustrative purposes and may not include the necessary detail to derive an actual signal. However, one with ordinary skill in the art will understand how the disclosed technology modifies audio signals based on these illustrative graphs. Additionally, these example graphs do not include a combined audio signal and a click noise signal (e.g., the received audio signal); however, one with ordinary skill in the art would understand how to derive such a combined signal based on digital signal processing algorithms such as Fourier Transforms (e.g., Fast Fourier Transforms (FFT)).

On the y-axis for each graph is an amplitude in decibels (dB) of frequency components of a signal. On the x-axis is a frequency in Hz. Each graph has an audio signal: audio signal 405*a* in FIG. 4A, audio signal 410*a* in FIG. 4B, audio signal 415*a* in FIG. 4C. Each graph also has a click noise signal: 405*b* in FIG. 4A, 410*b* in FIG. 4B, and 415*b* in FIG. 4C. A combined signal (e.g., a received signal from the T-coil) would include both the audio signal and the click noise signal.

Each graph also shows a threshold with a dashed line. The threshold indicates a dB value when a filter should be applied or not applied as explained in more detail in FIGS. 2, 3, and 5. The threshold value is based on when the perceptual module should be applied, e.g., when the received audio signal, which includes the audio signal from the T-Coil and the click noise created from interference, is above or below the threshold. Also, each graph shows an audible hearing level, which indicates above the audible hearing level it is possible to hear a signal and below the audible hearing level it is not possible to a signal. The audible hearing level is just for reference. In general, signals with an amplitude below an audible hearing level or in a frequency range that is not audible are generally not processed by the hearing device because it is likely a user will not hear or be affected by these signals. Accordingly, the adaptive filter is not applied to these signals (e.g., signals outside of the audible frequency range or below a detectable amplitude).

Regarding FIG. 4A, the audio signal 405*a* is below the audible hearing level and the click noise 405*b* is above the audible hearing level, but below the threshold by an amount of 405*c*. Accordingly, the hearing device would apply the filter to reduce (e.g., eliminate) the click noise sound. In contrast to FIG. 4A, FIG. 4B shows the audio signal 410*a* is above the click noise 410*b* and both signals are above the threshold (e.g., the audio signal is above the threshold by 410*c*). Accordingly, the hearing device 103 does not need to apply the filter because desired audio signal 410*a* is above (e.g., higher amplitude) the undesired click noise 410*b*, and when the signals around combined or processed and then provided to a user, a user would not hear or barely hear the click noise. Similarly, if both audio signal 410*a* and the click noise 410*b* were below the threshold and above the audio hearing level, the classifier could determine that the audio signal 410 is related to speech, a desired signal, whereas the click noise 410*b* is an undesired signal, and the hearing device would not apply a filter because the desired audio signal 410*a* is above (e.g., higher amplitude) than the undesired click noise 410*b*.

FIG. 4C is different than FIGS. 4A and 4B because the audio signal 415*a* is above the click noise 415*b* at some frequencies, but the audio signal 415*a* is also below the click noise 415*b* at different frequencies. The audio signal 415*a* is also above the threshold by an amount 415*c* for a period of time as shown in FIG. 4C. In this scenario, the hearing device can apply the adaptive filter selectively. For example, when the click noise 415*b* is above the audio signal 415*a* as shown at the beginning of the graph in FIG. 4C, the hearing device could classify and filter the noise signal and reduce its amplitude; however, this likely also negatively affect the desired audio signal. When the audio signal 415*a* is above the click noise 415*b*, the hearing device may not apply the filter because the audio signal 415*a* is above (e.g., higher amplitude) than the click noise 410 (same as FIG. 4B). On the right side of the graph, the click noise 415*b* is higher than the audio signal 415*a*, which would normally indicate that the hearing device should apply the filter. However, the click noise 415*b* is in the masking shadow (see dashed lines on graph) of the audio signal 415*a*. Specifically, the audio signal 415*a* had a higher amplitude than the click noise amplitude 415*b* just next to the frequency the click noise 410*b* had a higher amplitude. Accordingly, the audio signal 415*a* "shadows" or covers up the click noise 410*b* in this due to a masking effect of the audio signal over the click noise.

Similar to FIG. 4B, FIG. 4D shows that the audio signal 410*a* is above the click noise 410*b*. In contrast to a single threshold in FIG. 4B, FIG. 4D shows a first and second threshold. The first threshold can be considered a "soft" threshold and the second threshold can be considered a "hard threshold" based on an amount of filter that is applied. More specifically, the first threshold can include applying less than 100% weight of the filter whereas the second threshold generally means not applying the filter (e.g., 0% weight). The lower graph on FIG. 4D shows the adaptive filter weights on the y-axis and the frequency on the x-axis. When the audio signal 410*a* is higher than the first threshold, the adaptive filter is applied at less than 100% (e.g., 95%) and its weight decreases linearly until the audio signal 410 is higher than the second threshold, at which point the filter is not applied at all. Because the audio signal 410*a* is louder than the click noise 410 above the second threshold, it is assumed that the audio signal 410*a* perceptually masks the click noise 410*b*.

It should be noted that FIGS. 4A, 4B, 4C, and 4D are shown in the frequency domain, and in the temporal domain (not shown) there are also some perceptual masking effects. More specifically, the temporal and spectral masking are independent effects. The spectral masking (masking shadow as shown in FIG. 4C) is a static view at one point in time and does not include the temporal masking effects. Specifically, as explained in FIG. 2, a small amount of hold time allows for smooth activation of the adaptive filter 275 and gives the perceptual module 265 enough time to include the aspect of temporal forward masking during this hold time.

Figure 5:
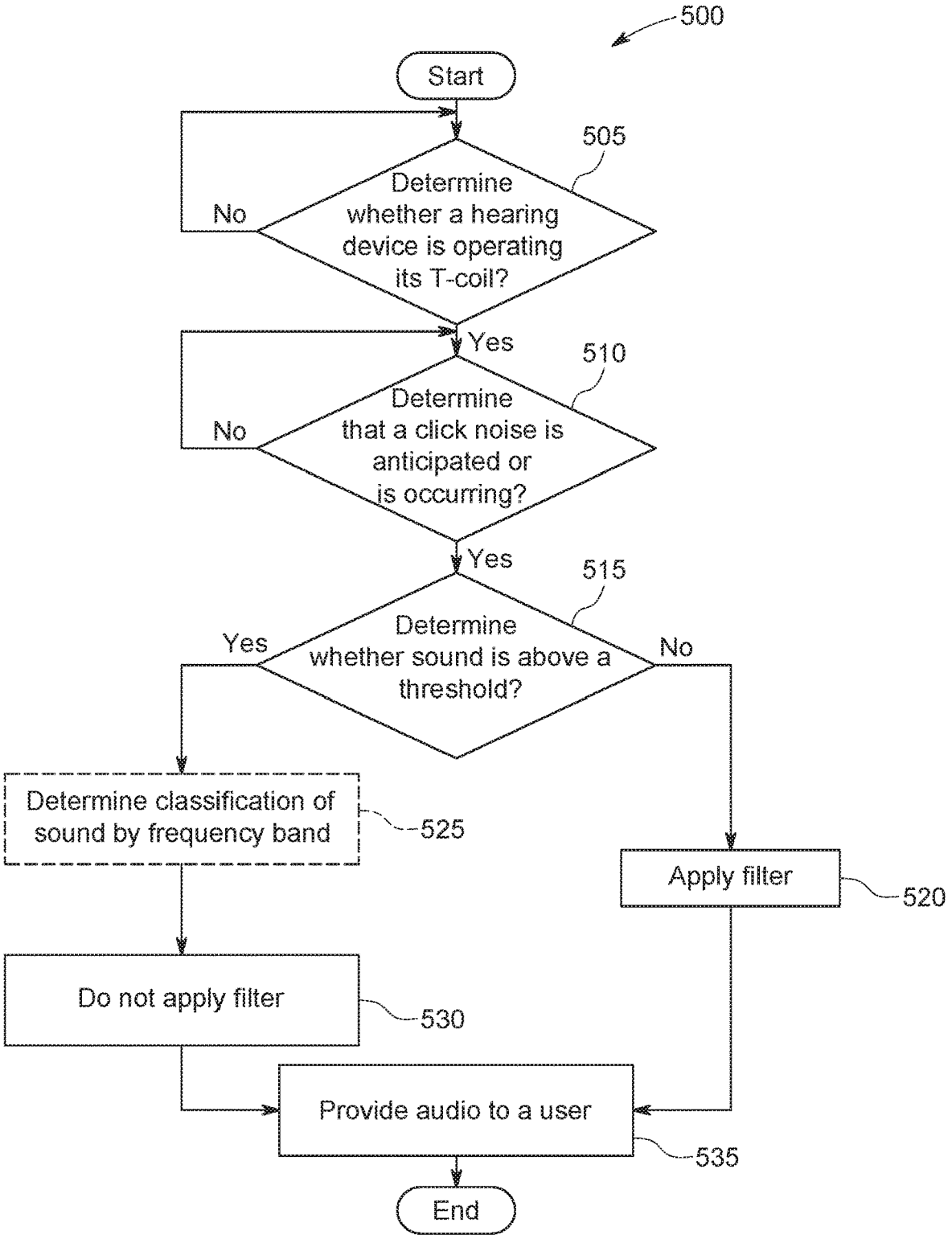
FIG. 5 illustrates a block flow diagram for a hearing device performing a process to reduce noise in accordance with some implementations of the disclosed technology.

FIG. 5 illustrates a block flow diagram for a process 500 for a hearing device to reduce noise (e.g., click noise created from unwanted EMI and a T-coil). A hearing device or a computer device can execute the process 500. In some implementations, part of the process 500 may be carried out on more than one device (e.g., two hearing devices perform the process 500 or a hearing device and a mobile device perform the process 500). The process 500 begins with a T-coil decision operation 505 and continues with operation 510.

At T-coil decision operation 505, the hearing device determines whether the hearing device is operating its T-coil. The hearing device can determine this based on the program it is using. For example, a hearing device can determine it is using a hearing program that includes receiving or streaming music or audio from a T-coil. The hearing device can also determine that its hearing device is in operation based on the processor determining that audio signals are being receiving from the T-coil. In some implementations, the hearing device determines that the T-coil is operational based on a user request, e.g., a user selects to activate the hearing device T-coil because he or she desires to receive audio signals through the T-coil. If the hearing device determines that In some implementations of the T-coil decision operation, the hearing device can determine a T-coil is in operation based a "touchless" t-coil option. The touchless T-coil option automatically detects that the T-coil is in operation when it senses a source of EM, and switches back when the EM field is no longer apparent. This type of system makes T-coil activation easier for a hearing device user (e.g., hearing aid user), particularly for those with limited or reduced dexterity.

At determine click noise anticipation operation 510, the hearing device determines that a click noise is anticipated. Anticipated generally means that the click noise is probable, expected, or predicted to occur shortly (e.g., within the next 1-20 microseconds). If a click noise is occurring currently, it can also be anticipated (e.g., the classifier is detecting active interference).

In some implementations, the hearing device determines that a click noise is anticipated based on receiving a notification from a transceiver, controller, or wireless chip of the hearing device. For example, a transceiver can send a notification to a processor of the hearing device that indicates the transceiver is expecting to transmit or receiving a packet, which implies that the antenna for the hearing device may receive an EM field that interferes with the T-coil to create an audio artifact for a T-coil audio. For example, the hearing device can determine that it will be receiving packet on an Industrial, Scientific, and Medical (ISM) band when using Bluetooth Classic or Bluetooth Low Energy™. Because the hearing device will use a 2.4 GHz band, it is likely that there will be some EMI between the antenna of the hearing device and the T-Coil. And because the transceiver is aware of this radio activity, it can send a notification that the radio activity will occur. there is generally a 1 millisecond lag between activating the radio activity and a ADC converting an audio signal. In some implementations, the transceiver can include timing information with the notification.

At determine sound level compared to threshold operation 515, the hearing device determines whether it will apply a filter based on a sound level of a processed audio signal being above, below, or equal to a threshold level. If the hearing device determines that the sound level is above the threshold, it can proceed to an operation classification operation 525 (the optional operation is shown with dashed lines). If the hearing device determines that the sound is below the threshold level, it can proceed to apply filter operation 520, where the adaptive filter can be applied on a frequency band basis as described in FIGS. 2, 3, 4A, 4B, and 4C. For example, the filter can be applied 100% or less than 100% depending on the sound level of the received audio signal.

At the optional classification operation 525, the hearing device can classify audio signals it is receiving. For example, the hearing device can classify whether a received signal from a T-coil is speech, noise, or both. Based on the classification, the hearing device can filter signals associated with speech differently than it filters signals associated with noise. The classifier can determine that a signal has a noise portion, which relates to frequencies or time periods with noise, and a sound portion, which relates to frequencies or time periods with desired sounds. the classification of the received audio signal can be used to adjust the filter.

If the optional classification operation 525 is completed or skipped (as it is an optional operation) and the sound level is above a threshold, the hearing device does not apply the filter in "not apply filter" operation 530 because the desired audio signal perceptually masks the undesired click noise because the desired audio signal is louder than the undesired click noise. For example, as shown in FIG. 4B. After not apply filter operation 530, the process 500 can end or be repeated. At provide audio to user operation 535, the hearing device can provided processed audio to user (e.g., the processed audio is filtered, partially filtered, not filtered, or mixed or combined with other signals). The provided audio has the click noised filtered or is loud enough such that the click noise is not audible (or barely audible).

Aspects and implementations of the process 500 of the disclosure have been disclosed in the general context of various steps and operations. A variety of these steps and operations may be performed by hardware components or may be embodied in computer-executable instructions, which may be used to cause a general-purpose or special-purpose processor (e.g., in a computer, server, or other computing device) programmed with the instructions to perform the steps or operations. For example, the steps or operations may be performed by a combination of hardware, software, and/or firmware such with a wireless communication device or a hearing device.

The phrases "in some implementations," "according to some implementations," "in the implementations shown," "in other implementations," and generally mean a feature, structure, or characteristic following the phrase is included in at least one implementation of the disclosure, and may be included in more than one implementation. In addition, such phrases do not necessarily refer to the same implementations or different implementations.

The techniques introduced here can be embodied as special-purpose hardware (e.g., circuitry), as programmable circuitry appropriately programmed with software or firmware, or as a combination of special-purpose and programmable circuitry. Hence, implementations may include a machine-readable medium having stored thereon instructions which may be used to program a computer (or other electronic devices) to perform a process. The machine-readable medium may include, but is not limited to, optical disks, compact disc read-only memories (CD-ROMs), magneto-optical disks, ROMs, random access memories (RAMs), erasable programmable read-only memories (EPROMs), electrically erasable programmable read-only memories (EEPROMs), magnetic or optical cards, flash memory, or other type of media/machine-readable medium suitable for storing electronic instructions. In some implementations, the machine-readable medium is non-transitory computer readable medium, where in non-transitory excludes a propagating signal.

The above detailed description of examples of the disclosure is not intended to be exhaustive or to limit the disclosure to the precise form disclosed above. While specific examples for the disclosure are described above for illustrative purposes, various equivalent modifications are possible within the scope of the disclosure, as those skilled in the relevant art will recognize. For example, while processes or blocks are presented in an order, alternative implementations may perform routines having steps, or employ systems having blocks, in a different order, and some processes or blocks may be deleted, moved, added, subdivided, combined, or modified to provide alternative or subcombinations. Each of these processes or blocks may be implemented in a variety of different ways. Also, while processes or blocks are at times shown as being performed in series, these processes or blocks may instead be performed or implemented in parallel, or may be performed at different times. Further any specific numbers noted herein are only examples: alternative implementations may employ differing values or ranges.

As used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc. As another example, "A or B" can be only A, only B, or A and B.

I claim:

1. A hearing device, the hearing device comprising:

a transceiver configured to transmit a notification that indicates a first antenna of the hearing device is expected to generate an electromagnetic (EM) field;

a second antenna configured to receive an audio signal, wherein the second antenna is susceptible to receiving EM interference from the generated EM field and the EM interference generates a noise in the received audio signal;

a processor configured to communicate with the transceiver and configured to process the received audio signal;

a memory storing instructions, that when executed by the processor, cause the hearing device to perform the following operations:

receive the notification while the second antenna is receiving the audio signal;

determine whether to apply a filter to the received audio signal based on an amplitude level of the received audio signal compared to a threshold during a duration of the expected noise; and provide a processed audio signal based on the received audio signal and the determination whether to apply the filter.

2. The hearing device of claim 1, wherein the amplitude level is associated with a frequency component of the received audio signal, wherein the operations further comprise:

determining that the amplitude level of the frequency component of the received audio signal is above the threshold and determining to not apply the filter.

3. The hearing device of claim 1, wherein the notification includes a timing when the first antenna is expected to generate the EM field.

4. The hearing device of claim 1, wherein the threshold is at least partially based on a property of a battery for the hearing device or properties of electronic circuitry for the hearing device.

5. The hearing device of claim 1, wherein the operations further comprise:

applying the filter on a frequency band basis.

6. The hearing device of claim 1, wherein the second antenna is a telecoil, and wherein the first antenna is an antenna configured to receive or transmit an EM signal in an industrial, scientific, and medical (ISM) unlicensed band.

7. The hearing device of claim 1, wherein the hearing device further comprises:

a classifier configured to classify the received audio signal into a speech portion and noise portion.

8. A method to provide audio information to a user, the method comprising:

receiving a notification that a first antenna is expected to generate an electromagnetic (EM) field that interferes with a second antenna while the second antenna is receiving an audio signal, wherein the interference creates an audible noise in the received audio signal;

determining whether to apply a filter to the received audio signal based on the received notification and a comparison of an amplitude level the received audio signal to a threshold; and providing a processed audio signal based on the received audio signal and the determination whether to apply the filter.

9. The method of claim 8, wherein the amplitude level is associated with a frequency component of the received audio signal, and where the method further comprises:

determining that the amplitude level of the frequency component of the received audio signal is above the threshold and determining to not apply the filter.

10. The method of claim 8, wherein the amplitude level is associated with a frequency component of the received audio signal, wherein the threshold is first threshold, and wherein the method further comprises:

determining that the amplitude level of the frequency component of the received audio signal is below the first threshold and applying the filter; or determining that the amplitude level of the frequency component of the received audio signal is between the first threshold and a second threshold and applying the filter with an adjusted weighting, wherein the adjusted weighting is based on the amplitude level, and wherein the adjusted weight is less than 100 percent.

11. The method of claim 8, the method further comprising:

classifying the received audio signal into a speech portion and a noise portion; and determining the speech portion has a higher sound level than the noise portion and not applying the filter based on a masking effect of the speech portion.

12. The method of claim 8, the method further comprising:

determining not to apply the filter to the received audio signal because the sound level is below an audible threshold.

13. The method of claim 8, the method further comprising:

determining that the sound level is above the threshold and not applying the filter based on a masking shadow of the audio signal.

14. The method of claim 8, the method further comprising:

determining that the sound level is below the threshold and applying the filter on a frequency band basis.

15. The method of claim 8, the determining occurs during a duration of the audible noise, and wherein the duration of the audio noise is based on timing information included in the notification.

16. The non-transitory computer-readable medium of claim 15, wherein the threshold is first threshold, wherein the operations further comprise:

adjusting a weight of the filter based on determining that the amplitude is between the first threshold and a second threshold; and applying the filter with the adjusted weight.

17. The non-transitory computer-readable medium of claim 15, wherein the operations further comprise:

classifying the received audio signal into a speech portion and a noise portion; and determining the speech portion has a higher sound level than the noise portion and not applying the filter based on a masking effect of the speech portion, wherein the noise portion is associated with a clicking noise.

18. The non-transitory computer-readable medium of claim 15, the operations further comprising:

determining that the sound level of the received audio signal is below the threshold and applying the filter; or determining that the sound level is above the threshold and not applying the filter based on a masking shadow of the audio signal.

19. The non-transitory computer-readable medium of claim 15, wherein the threshold is at least partially based on a property of a battery of the hearing device or electric circuitry for the hearing device.

20. The non-transitory computer-readable medium of claim 15, wherein the threshold is associated with a sound level.

21. A non-transitory computer-readable medium storing instructions, that when executed by a hearing device that cause the hearing device to perform operations, the operations comprise:

receiving a notification that a first antenna is expected to generate an electromagnetic (EM) field that interferes with a second antenna while the second antenna is receiving an audio signal, wherein the interference creates an audible noise in the received audio signal;

determining whether to apply a filter to the received audio signal based on an amplitude level the received audio signal compared to a threshold during a duration of the audible noise; and providing a processed audio signal based on the received audio signal.

* * * * *